US012735951B2

(12) United States Patent
Saebo et al.

(10) Patent No.: US 12,735,951 B2
(45) Date of Patent: Sep. 15, 2026

(54) INTEGRATED LINE SYSTEM FOR A MINERAL EXTRACTION SYSTEM

(71) Applicant: Schlumberger Technology Corporation, Sugar Land, TX (US)

(72) Inventors: Glenn Thore Saebo, Kristiansand (NO); Vikas Rakhunde, Cypress, TX (US); Taylor Mozisek, Fulshear, TX (US); Jon Tyler, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 34 days.

(21) Appl. No.: 18/685,280

(22) PCT Filed: Aug. 17, 2022

(86) PCT No.: PCT/US2022/040539

§ 371 (c)(1),
(2) Date: Feb. 21, 2024

(87) PCT Pub. No.: WO2023/027919

PCT Pub. Date: Mar. 2, 2023

(65) Prior Publication Data

US 2024/0368952 A1 Nov. 7, 2024

Related U.S. Application Data

(60) Provisional application No. 63/235,886, filed on Aug. 23, 2021.

(51) Int. Cl.
*E21B 21/08* (2006.01)
*E21B 47/06* (2012.01)

(52) U.S. Cl.
CPC ..... *E21B 21/08* (2013.01); *E21B 47/06* (2013.01)

(58) Field of Classification Search
CPC ..... E21B 21/08; E21B 47/06
(Continued)

(56) References Cited

U.S. PATENT DOCUMENTS 4,813,495 A * 3/1989 Leach ..... E21B 21/08 175/6
7,562,723 B2 7/2009 Reitsma
(Continued)

FOREIGN PATENT DOCUMENTS

WO 2017023710 A1 2/2017
WO 2019014431 A1 1/2019
(Continued)

*Primary Examiner* — Tara Schimpf
*Assistant Examiner* — Patrick F Lambe
(74) *Attorney, Agent, or Firm* — Jeffrey D. Frantz

(57) ABSTRACT

A system includes a drilling fluid flow path configured to be selectively utilized with a well control drilling technique during a first drilling operation and a managed pressure drilling (MPD) technique during a second drilling operation. The system includes a first manifold assembly coupled to the drilling fluid flow path, wherein the first manifold assembly includes a drilling choke configured to be utilized with the well control drilling technique and coupled to a set of lines coupled to a blowout preventer coupled to a wellhead. The system includes a second manifold assembly coupled to the drilling fluid flow path, wherein the first manifold assembly includes a MPD choke configured to be utilized with the MPD technique. The system includes a set of lines coupled to one or more components of a wellhead assembly, wherein both the drilling choke and the MPD choke are coupled to the set of lines.

8 Claims, 3 Drawing Sheets

(58) Field of Classification Search
USPC ..... 166/368
See application file for complete search history.

(56) References Cited

U.S. PATENT DOCUMENTS

| | | | | |
|---|---|---|---|---|
| 8,307,913 | B2 | 11/2012 | Dolman | |
| 9,376,875 | B2 | 6/2016 | Reitsma | |
| 9,976,393 | B2 | 5/2018 | Gilmore | |
| 10,400,552 | B2 | 9/2019 | Gilmore | |
| 10,487,950 | B2 | 11/2019 | Whitby | |
| 10,648,315 | B2 | 5/2020 | Couturier | |
| 10,830,009 | B2 | 11/2020 | Orban | |
| 2016/0097270 | A1 | 4/2016 | Pobedinski | |
| 2018/0238128 | A1* | 8/2018 | Gardner | E21B 21/10 |
| 2018/0238129 | A1 | 8/2018 | Gardner | |
| 2019/0120000 | A1* | 4/2019 | Santos | E21B 33/06 |
| 2021/0010338 | A1 | 1/2021 | Santos | |
| 2021/0010365 | A1 | 1/2021 | Botnan et al. | |
| 2021/0348461 | A1* | 11/2021 | Teixeira | E21B 21/08 |
| 2022/0403709 | A1* | 12/2022 | Clark | E21B 34/025 |

FOREIGN PATENT DOCUMENTS

| | | | |
|---|---|---|---|
| WO | 2019173840 | A1 | 9/2019 |
| WO | 2019173841 | A1 | 9/2019 |
| WO | 2019173842 | A1 | 9/2019 |
| WO | 2021076704 | A1 | 4/2021 |

* cited by examiner

INTEGRATED LINE SYSTEM FOR A MINERAL EXTRACTION SYSTEM

CROSS-REFERENCE TO RELATED APPLICATION

This application claims priority to International Application No. PCT/US2022/040539, entitled "INTEGRATED LINE SYSTEM FOR A MINERAL EXTRACTION SYSTEM," filed Aug. 17, 2022, which claims priority to and the benefit of U.S. Provisional Patent Application No. 63/235,886, entitled "INTEGRATED LINE SYSTEM FOR A MINERAL EXTRACTION SYSTEM," filed Aug. 23, 2021, the disclosures of which are hereby incorporated herein by reference in their entirety.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems may include a drilling fluid system configured to circulate drilling fluid into and out of a wellbore to facilitate the drilling process. In some cases, the drilling fluid may be directed to a platform of the drilling system, where the drilling fluid may be filtered and/or otherwise processed before being directed back into the wellbore. Manifolds that receive the drilling fluid include pipes and/or valves that direct the drilling fluid to various locations of the system, and such manifolds may be configured for specific types of drilling. Therefore, multiple manifolds may be included in the drilling system in order to enable the system to perform multiple types of drilling techniques. The components to enable utilization of multiple types of drilling techniques may be expensive and include a relatively large footprint.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Mineral extraction systems may include multiple manifolds to enable the system to switch between multiple types of drilling techniques (e.g., managed pressure drilling and well control drilling). It may be desirable to switch between drilling techniques based on a hardness of a particular layer in which drilling is occurring. Unfortunately, each manifold that may be included in the different types of mineral extraction systems may be associated with its own set of lines for conducting drilling operations resulting in a relatively large footprint. Accordingly, embodiments of the present disclosure relate to a mineral extraction system that utilizes different types of drilling techniques that share an integrated line system. Such an integrated line system includes a reduced footprint when compared to utilizing separate line systems. In addition, due to the utilization of an integrated line system, certain components may be eliminated (e.g., a gooseneck that couples lines for a managed pressure drilling (MPD) system to a riser). Further, the integrated line system may reduce costs by utilizing fewer components.

Figure 1:
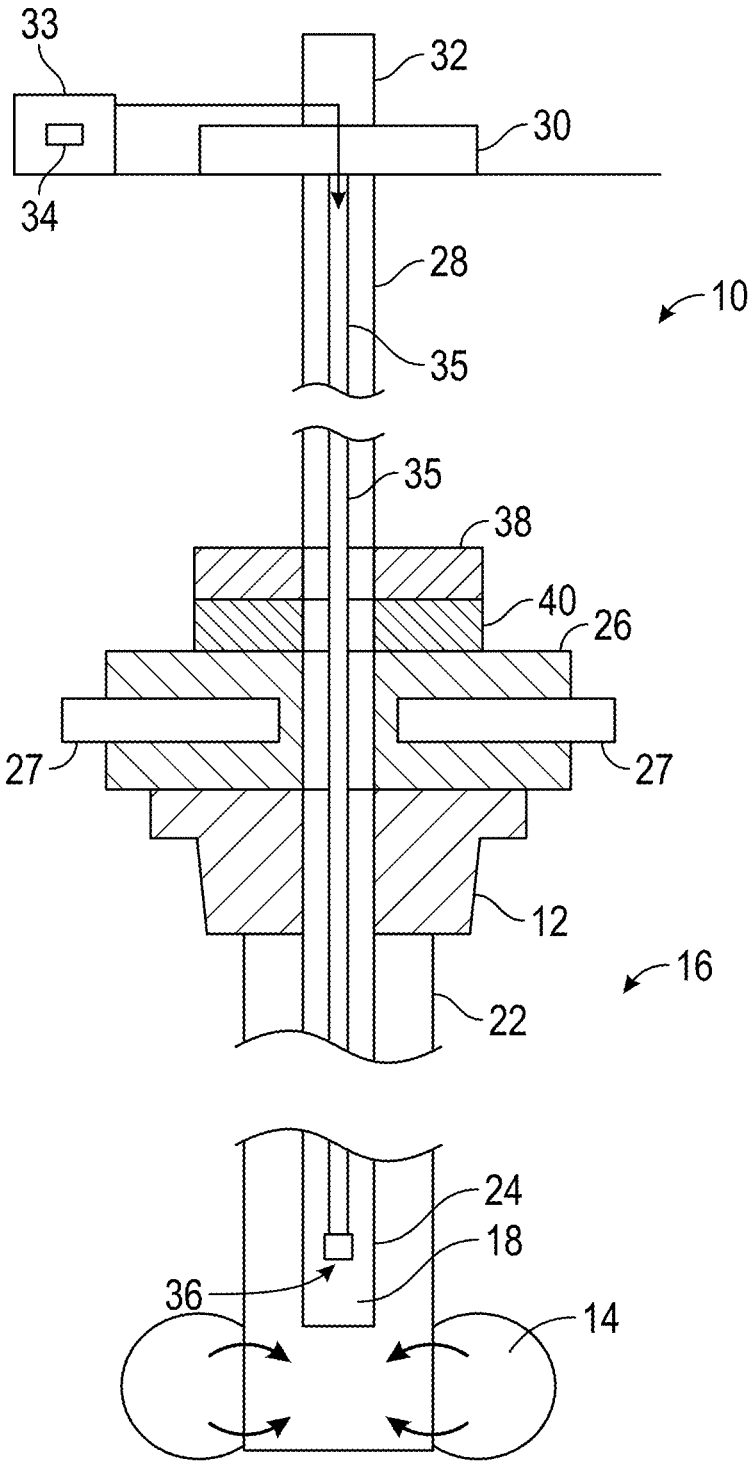
FIG. 1 is a schematic of a mineral extraction system that includes a manifold assembly for different types of drilling techniques, in accordance with an aspect of the present disclosure.

To help illustrate the manner in which the present embodiments may be used in a system, FIG. 1 is a block diagram that illustrates an embodiment of a mineral extraction (e.g., drilling) system 10. The illustrated mineral extraction system 10 can be configured to extract various minerals and natural resources, including hydrocarbons (e.g., oil and/or natural gas), or configured to inject substances (e.g., drilling fluid, particle laden fluids or frac fluids, chemicals, gases, water, mud, etc.) into the earth. In some embodiments, the mineral extraction system 10 is land-based (e.g., a surface system) or subsea (e.g., a subsea system). As illustrated, the system 10 includes a wellhead assembly 12 coupled to a mineral deposit 14 via a well 16, wherein the well 16 includes a wellbore 18.

The wellhead assembly 12 typically includes multiple components that control and regulate activities and conditions associated with the well 16. For example, the wellhead assembly 12 generally includes pipes, bodies, valves and seals that enable drilling of the well 16, route produced minerals from the mineral deposit 14, provide for regulating pressure in the well 16, and provide for the injection of drilling fluids into the wellbore 18 (down-hole). For example, FIG. 1 illustrates a conductor 22 (also referred to as "conductor casing") disposed in the well 16 to provide structure for the well 16 and prevent collapse of the sides of the well 16 into the wellbore 18. One or more casings 24, such as surface casing, intermediate casing, etc., may be fully or partially disposed in the bore of the conductor 22. The casing 24 also provides a structure for the well 16 and wellbore 18 and provides for control of fluid and pressure during drilling of the well 16. The wellhead 12 may include, a tubing spool, a casing spool, and a hanger (e.g., a tubing hanger or a casing hanger), to enable installation of casing and/or tubing. The system 10 may include other devices that are coupled to the wellhead 12, such as a blowout preventer (BOP) 26 and devices that are used to assemble and control various components of the wellhead 12.

The BOP 26 may include a variety of valves, fittings and controls to prevent oil, gas, or other fluid from exiting the well in the event of an unintentional release of pressure or an unanticipated overpressure condition. As used herein the term "BOP" may also refer to a "BOP stack" having multiple blowout preventers. The BOP 26 may be hydraulically operated and may close the wellhead assembly 12 or seal off various components of the wellhead assembly 12. During operation of the system 10, a BOP 26 may be installed during removal or installation of additional components, changes in operation of the system 10, or for other reasons. The BOP 26 may be any suitable BOP, such as a ram BOP, an annular BOP, or any combination thereof. The BOP 26 shown in FIG. 1 may be a ram BOP having radially moveable rams 27 configured to close off the bore of the BOP 26 and seal the well 16.

A drilling riser 28 may extend from the BOP 26 to a rig 30, such as a platform or floating vessel. The rig 30 may be positioned above the well 16. The rig 30 may include the components suitable for operation of the mineral extraction system 10, such as pumps, tanks, power equipment, and any other components. The rig 30 may include a derrick 32 to support the drilling riser 28 during running and retrieval, a tension control mechanism, and any other components.

The drilling riser 28 may carry drilling fluid (e.g., "mud") from the rig 30 to the well 16, and may carry the drilling fluid ("returns"), cuttings, or any other substance, from the well 16 to the rig 30. For example, in certain embodiments, the mineral extraction system 10 may include a drilling fluid system 33 that directs the drilling fluid from a source, into the well 16, and back out of the well 16 to a predetermined destination (e.g., a waste container, a reserve pit, or another fluid container). The drilling fluid system 33 may include a manifold assembly 34 that may enable multiple types of drilling procedures to be performed by the mineral extraction system 10. In certain embodiments, the manifold assembly may include a single common assembly for performing multiple types of drilling procedures. In other embodiments, the manifold assembly may include separate manifold assemblies for performing the different types of drilling procedures. The drilling riser 28 may also include a drill pipe 35. The drill pipe 35 may be connected centrally over the bore (such as coaxially) of the well 16, and may provide a passage from the rig 30 to the well 16.

FIG. 1 depicts operation of the mineral extraction system 10 during drilling of the well. As shown in FIG. 1, the drill pipe 35 extends from the derrick 32 through the BOP 26, through the drilling riser 28, and into the well-bore 18. The drill pipe 35 may be coupled to a tool, e.g., a drill bit, to aid in drilling the well. For example, in one embodiment the drill pipe 35 may be rotated and/or translated to drill and create the well. Drilling fluid may be directed toward an end 36 of the drill pipe 35 to facilitate movement of the drill pipe 35 and/or the tool (e.g., drill bit) within the well 16. Specifically, the drilling fluid may remove the cuttings and/or other solids from the end 36 of the drill pipe 35 that may block movement of the drill pipe 35 and/or the drill bit. Additionally, the drill pipe 35 may be extended or retracted by adding or removing sections to the drill pipe 35.

As shown, the mineral extraction system 10 may include a rotating control device (RCD) system 38 that is configured to form a seal across and/or to block fluid flow through the annular space that surrounds the drilling riser 28. For example, the RCD system 38 may be configured to block the drilling fluid, cuttings, and/or other substances from the well 16 from passing across a seal element of the RCD system 38 toward the platform 30. The RCD system 38 may be positioned at any suitable location within the drilling system 10, such as any suitable location between the wellbore 18 and the platform 30. For example, as shown, the RCD system 38 may positioned between the BOP assembly 26 and the platform 30.

As shown, the mineral extraction system 10 may include a flow diverter assembly 40 (e.g., flow spool) axially disposed along the riser 28 between the RCD system 38 and the BOP assembly 26. The diverter assembly 40 is configured (when the RCD system 38 is sealing the annular space of the drilling riser 28) to divert drilling fluids, cuttings, and gas safely away from the drill floor while the annulus above it is isolated. The diverter assembly 40 enables various MPD operations including applied surface backpressure drilling, pressurized mud cap drilling, and riser gas handling.

In accordance with embodiments of the present disclosure, the manifold assembly 34 may be configured to enable both managed pressure drilling ("MPD") and well control drilling ("WCD").

As used herein, MPD may refer to drilling operations that may be utilized when drilling through a sea floor made of relatively soft materials (i.e., materials other than hard rock). MPD may regulate the pressure and flow of drilling fluid through an inner drill string to ensure that the drilling fluid flow into the wellbore 18 does not over pressurize the wellbore 18 (i.e., expand the wellbore 18) or allow the wellbore 18 to collapse under its own weight. The ability to manage the drilling fluid pressure therefore enables drilling of mineral reservoirs in locations with softer sea beds.

Additionally, WCD may refer to more traditional drilling techniques that do not control pressure within the wellbore 18 with as much accuracy as MPD. Rather, WCD techniques may utilize a choke line and a choke valve that enables a pressure drop of drilling fluid exiting the wellbore 18, but does not ultimately provide for accurate pressure control within the wellbore 18. It may be beneficial to utilize WCD techniques when the formation includes relatively hard material (e.g., rock). Such formations may withstand higher pressures of drilling fluid without cracking and/or otherwise enabling drilling fluid to leak into the formation. Accordingly, fine control of the drilling fluid pressure in the wellbore 18 may not be necessary.

However, it may be beneficial for a mineral extraction system 10 to switch (e.g., via a controller) between drilling techniques such as MPD and WCD based on a hardness of a particular layer in which drilling is occurring and/or another operating parameter of the mineral extraction system 10 (e.g., pressure, temperature, formation type, mineral type, drilling fluid type, etc.). As a non-limiting example, a formation may include multiple layers, which may include different materials that include different hardness levels. Accordingly, it may be desirable to switch from WCD to MPD when entering a layer of the formation that is relatively soft to adjust the pressure of the drilling fluid and ensure that the drilling fluid does not crack the formation and/or allow drilling fluid to leak into the formation. Similarly, when entering a layer of the formation that is relatively hard, it may be beneficial to switch from MPD to WCD because control of the drilling fluid pressure may not be necessary.

Figure 2:
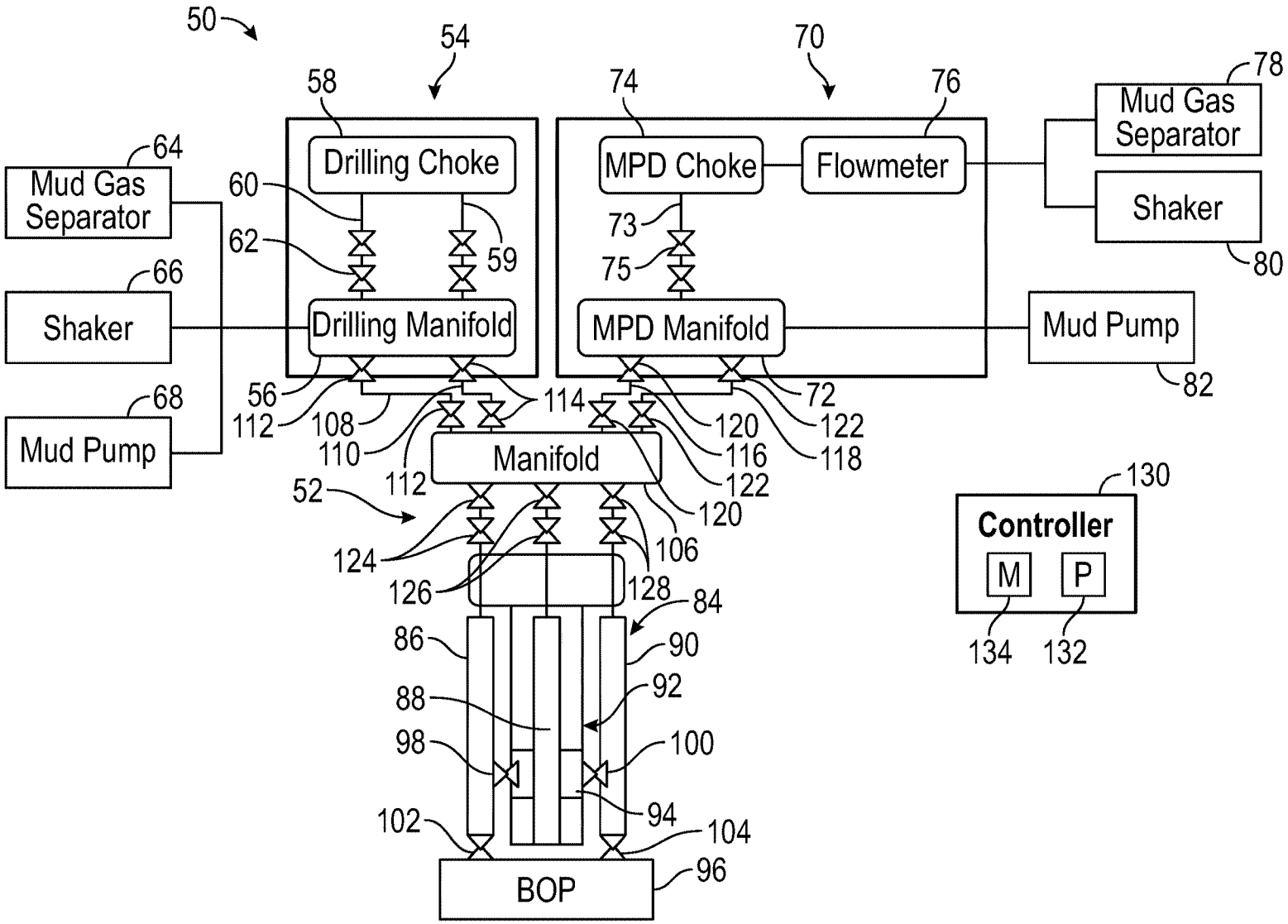
FIG. 2 is a schematic of a drilling fluid system utilizing an integrated line system for different types of drilling techniques (e.g., with separate manifold assemblies), in accordance with an aspect of the present disclosure.

FIG. 2 is a schematic of a drilling fluid system 50 utilizing an integrated line system 52 for different types of drilling techniques. For simplicity, some of the components of the mineral extraction system 10 are not illustrated (e.g., a complete riser or wellhead assembly). The drilling fluid system 50 includes a first manifold assembly 54 (e.g., drilling or WCD choke manifold assembly) that is configured for utilization during WCD operation. The first manifold assembly 54 includes a drilling manifold 56 and a drilling choke 58 coupled via lines 59, 60. Valves 62 (e.g., dual valves) disposed along the lines 59, 60 may control fluid flow between the drilling manifold 56 and the drilling choke 58 (e.g., pressure control valve). The drilling choke 58 is configured to function in the system to ensure pressure control during drilling operations and during a kick (blowout). The drilling system 50 also includes a mud gas separator 64 (e.g., a flash chamber and/or another chamber that may enable gas to separate from the drilling fluid) configured to separate the minerals (e.g., hydrocarbons) from the drilling fluid. The drilling system 50 also include a shaker 66 (e.g., a perforated or mesh plate that may undergo vibrations to remove large particles from the drilling fluid) and a mud pump 68 (e.g., for circulating drilling fluid under high pressure down the drill string and back up the annulus). The mud gas separator 64, the shaker 66, and the mud pump 68 are coupled to the drilling manifold 56.

The drilling system 50 also includes a second manifold assembly 70 (e.g., MPD choke manifold assembly) that is configured for utilization during MPD operation. The second manifold assembly 70 includes a MPD manifold 72 and a MPD choke 74. The MPD manifold 72 is coupled to the MPD choke 74 via line 73. Valves 75 (e.g., dual valves) disposed along the line 73 may control fluid between the MPD manifold 72 and the MPD choke 74 (e.g., choke valve). The MPD choke 74 is configured to control the backpressure of the drilling fluid (e.g., drilling mud) within the wellbore. The second manifold assembly 70 also includes a flow meter 76 configured to measure a flow rate of the drilling fluid. The drilling system 50 also includes another mud gas separator 78 configured to separate the minerals (e.g., hydrocarbons) from the drilling fluid and another shaker 80 (e.g., a perforated or mesh plate that may undergo vibrations to remove large particles from the drilling fluid). The flow meter 76, the mud gas separator 78, and the shaker 80 are coupled to the MPD choke 74. The drilling system 50 also includes another mud pump 82 coupled to the MPD manifold 72. In certain embodiments, the drilling system 50 may utilize a single mud gas separator, a single shaker, and/or a single mud pump for both the manifold assemblies 54, 70. Both of the manifold assemblies 54, 70 (and associated components such as the mud gas separator, shaker, mud pumps, etc.) may be located upon a platform as described in FIG. 1. It should be noted that the choke operations for WCD and MPD differ both in operating pressures and precisions (with the MPD occurring at higher pressures and requiring more precision).

As depicted, both of the manifold assemblies 54, 70 are coupled to the integrated line system 52. The integrated line system 52 includes a set of lines 84 that can be utilized during different drilling operations (e.g., WCD and MPD). The set of lines 84 includes lines 86, 88, and 90 running along a telescopic joint 92. Lines 86 and 90 are coupled both to a flow diverter or flow spool 94 and a BOP assembly 96 (e.g., located below the telescopic joint 92). During WCD, the lines 86 and 90 may be utilized as pressure control lines. In particular, the lines 86 and 90 may function as a kill line and a choke line, respectively. Line 88 may be utilized as a mud boost line (e.g., for pumping mud into the riser annulus just above the BOP stack 96 to improve return of cuttings). The flow spool 94 may be coupled to the lines 86 and 90 via valves 98 and 100, respectively. The lines 86 and 90 may be coupled to the BOP assembly 96 via valves 102 and 104, respectively. During WCD, when the line 86 is utilized as a kill line, valve 102 is open. During WCD, when the line 90 is utilized as a choke line, valve 104 is open. During WCD, the valves 98 and 100 are closed. During MPD, the lines 86 and 90 may be utilized as mud return lines. During MPD, valves 102 and 104 are closed and valves 98 and 100 are open.

Both the drilling manifold 56 and the MPD manifold 72 are coupled to a common manifold 106. In particular, the drilling manifold 56 is coupled to the common manifold 106 via lines 108 and 110. Lines 60 and 108 may form the kill line along with line 86. Lines 59 and 110 may form the choke line along with line 90. Valves 112 (e.g., dual valves) may regulate flow between the drilling manifold 56 and the common manifold 106 along line 108. Valves 114 (e.g., dual valves) may regulate flow between the drilling manifold 56 and the common manifold 106 along line 110. The MPD manifold 72 is coupled to the common manifold 106 via lines 116 and 118. Lines 116 and 118 may form the mud return lines along with lines 86 and 90. Valves 120 (e.g., dual valves) may regulate flow between the MPD manifold 72 and the common manifold 106 along line 116. Valves 122 (e.g., dual valves) may regulate flow between the MPD manifold 56 and the common manifold 106 along line 118.

Lines 86, 88, and 90 are coupled to the common manifold 106 via valves 124, 126, and 128 (e.g., dual valves), respectively. These valves 124, 126, 128 regulate flow along lines 86, 88, and 90 during both WCD and MPD operations.

Components of the drilling fluid system 50 (e.g., manifold assemblies 54, 76) may be coupled to a controller 130 (e.g., electronic controller having a processor 132 and a memory 134). For example, the controller 130 may control or regulate which mode of operation is utilized (e.g., WCD or MPD). In addition, the controller 130 may control or regulate (e.g., open or close) the various valves associated with the various lines to determine which lines are utilized and how the lines are utilized with respect to the different drilling operations (e.g., WCD and MPD).

It should be appreciated that the controller 130 may be a dedicated controller for the drilling fluid system 50 and/or the controller 130 may be part of or include a distributed controller with one or more electronic controllers in communication with one another to carry out the various techniques disclosed herein. The processor 132 may also include one or more processors configured to execute software, such as software for processing signals and/or controlling the components of the drilling fluid system 50. The memory 134 disclosed herein may include one or more memory devices (e.g., a volatile memory, such as random access memory [RAM], and/or a nonvolatile memory, such as read-only memory [ROM]) that may store a variety of information and may be used for various purposes. For example, the memory 134 may store processor-executable instructions (e.g., firmware or software) for the processor 132 to execute, such as instructions for processing signals and/or controlling the components of the fluid drilling system 50. It should be appreciated that the controller 130 may include various other components, such as a communication device that is capable of communicating data or other information to various other devices (e.g., a remote computing system or display system at the platform).

Figure 3:
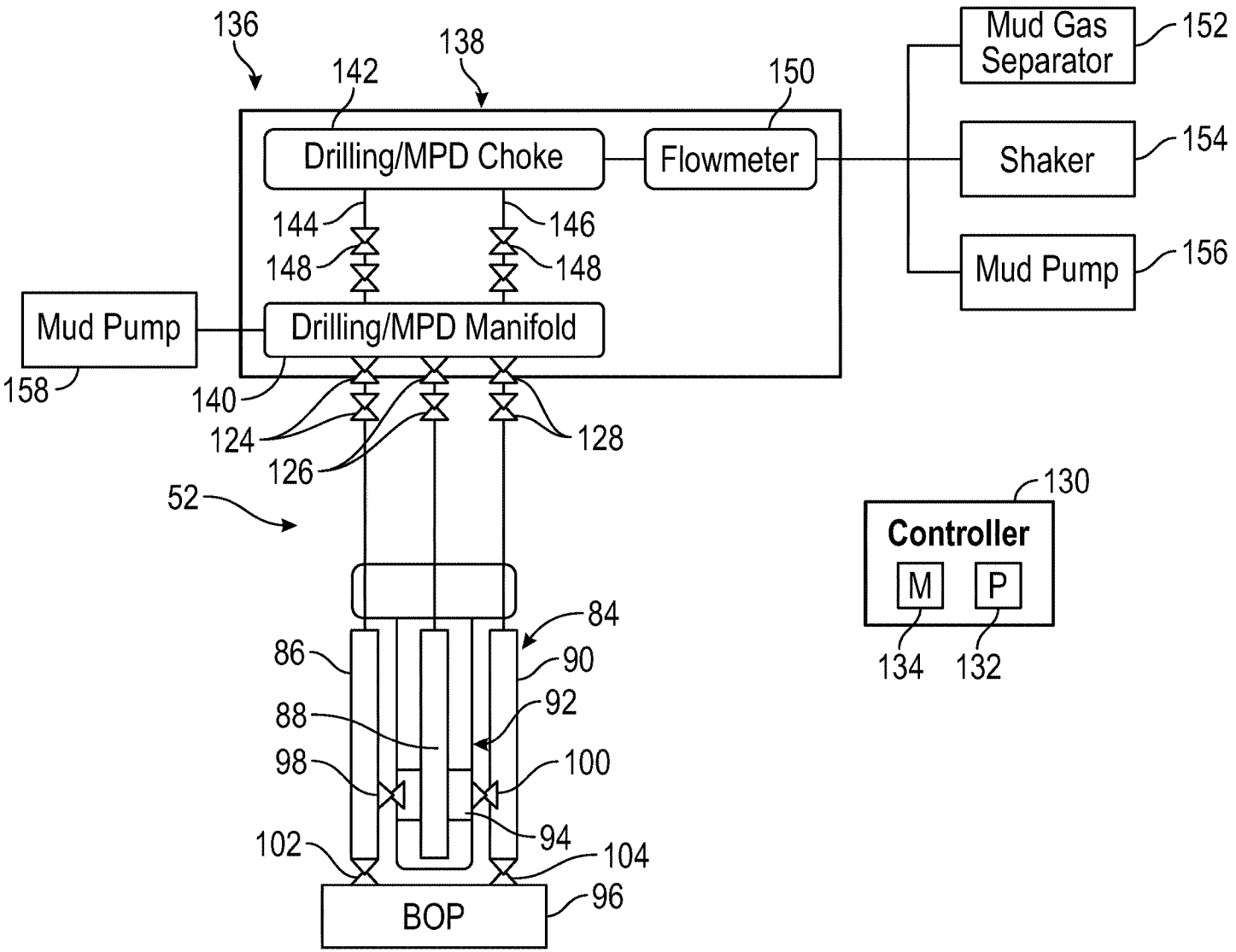
FIG. 3 is a schematic of a drilling fluid system utilizing an integrated line system for different types of drilling techniques (e.g., with a common manifold assembly), in accordance with an aspect of the present disclosure.

FIG. 3 is a schematic of a drilling fluid system 136 utilizing an integrated line system 52 for different types of drilling techniques. For simplicity, some of the components of the mineral extraction system 10 are not illustrated (e.g., a complete riser or wellhead assembly). The drilling fluid system 136 includes a single integrated manifold assembly 138 that is configured for utilization for operations during both WCD and MPD. The manifold assembly 138 includes a manifold 140 (e.g., drilling/MPD choke manifold) and a choke 142 (e.g., drilling/MPD choke) coupled via lines 144, 146. Valves 148 (e.g., dual valves) disposed along the lines 144, 146 may control fluid flow between the manifold 140 and the choke 142. The choke 142 is configured, during WCD, to function in the system to ensure pressure control during drilling operations and during a kick (blowout). The choke 142 is configured, during MPD, to control the back-pressure of the drilling fluid (e.g., drilling mud) within the wellbore. The choke 142 is coupled to a flow meter 150 configured to measure a flow rate of a fluid. The drilling fluid system 136 also includes a mud gas separator 152, a shaker 154, and a mud pump 68 coupled to the flow meter 150. The drilling fluid system 136 also includes another mud pump 158 coupled to the manifold 140.

As depicted, the manifold assembly 138 is coupled to the integrated line system 52. The integrated line system 52 is as described in FIG. 2 except the manifold 140 is directly coupled to the integrated line system 52 without an intervening manifold. In particular, valves 124, 126, and 128 directly couple the manifold to the lines 86, 88, and 90, respectively.

During WCD, when the line 86 is utilized as a kill line, valve 102 is open. During WCD, when the line 90 is utilized as a choke line, valve 104 is open. During WCD, the valves 98 and 100 are closed. During MPD, the lines 86 and 90 may be utilized as mud return lines. During MPD, valves 102 and 104 are closed and valves 98 and 100 are open.

During WCD, lines 144 and 86 form the kill line and lines 146 and 90 form the choke line. During MPD, lines 144 and 86 form a mud return line and lines 146 and 90 form a mud return line.

While the presently disclosed embodiments may be susceptible to various modifications and alternative forms, specific embodiments have been shown by way of example in the drawings and have been described in detail herein. However, it should be understood that the present disclosure is not intended to be limited to the particular forms disclosed. Rather, the present disclosure is to cover all modifications, equivalents, and alternatives falling within the spirit and scope of the present disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A drilling system, comprising:

a drilling fluid flow path configured to be selectively utilized with a well control drilling technique during a first drilling operation and a managed pressure drilling (MPD) technique during a second drilling operation;

a first set of lines coupled to a blowout preventer coupled to a wellhead, wherein the first set of lines run along a telescopic joint and are configured to be utilized as a mud boost line;

a rotating control device positioned between the blowout preventer and the wellhead, wherein the rotating control device is configured to block fluid flow through an annular space surrounding a drilling riser;

a flow diverter assembly positioned between the rotating control device and the blowout preventer, wherein the flow diverter assembly is configured to divert drilling fluids, cuttings, and gas away from a drill floor;

a first manifold assembly coupled to the drilling fluid flow path, wherein the first manifold assembly comprises a drilling choke configured to be utilized with the well control drilling technique and coupled to the first set of lines, wherein the first manifold assembly is coupled to the drilling choke via a second set of lines;

a second manifold assembly coupled to the drilling fluid flow path, wherein the second manifold assembly comprises a MPD choke configured to be utilized with the MPD technique, wherein the second manifold assembly is coupled to the MPD choke via a third set of lines;

a fourth set of lines coupled to one or more components of a wellhead assembly, wherein the fourth set of lines comprises a first line and a second line, wherein, during the first drilling operation, the first line is configured to be utilized as a choke line, and the second line is configured to be utilized as a kill line, and wherein, during the second drilling operation, the first and second lines are configured to be utilized as fluid return lines;

a plurality of valves disposed along the fourth set of lines;

a third manifold assembly coupled to the first manifold assembly and the second manifold assembly, wherein the third manifold assembly is coupled to the first manifold assembly via a fifth set of lines, wherein a first set of valves comprising one or more of the plurality of valves are configured to regulate flow between the first manifold assembly and the third manifold assembly along the fifth set of lines, wherein the third manifold assembly is coupled to the second manifold assembly via a sixth set of lines, and wherein a second set of valves comprising one or more of the plurality of valves are configured to regulate flow between the second manifold assembly and the third manifold assembly along the sixth set of lines; and a controller communicatively coupled to the plurality of valves, wherein the controller is configured to control the plurality of valves to switch between the first drilling operation and the second drilling operation.

2. The drilling system of claim 1, wherein the controller is configured to control the plurality of valves to enable utilization of the first line as the choke line and the second line as the kill line during the first drilling operation and to control the plurality of valves to enable utilization of the first and second lines as fluid return lines during the second drilling operation.

3. The drilling system of claim 1, wherein the first manifold assembly and the second manifold assembly are separate from one another.

4. The drilling system of claim 3, wherein the fourth set of lines are coupled to a common manifold downstream of both the first manifold assembly and the second manifold assembly.

5. The drilling system of claim 1, wherein the first manifold assembly and the second manifold assembly form a single manifold assembly.

6. The drilling system of claim 1, wherein the fourth set of lines is coupled to the blowout preventer.

7. The drilling system of claim 6, wherein the fourth set of lines is coupled to a flow spool.

8. The drilling system of claim 1, wherein the plurality of valves comprises a first valve, a second valve, a third valve, and a fourth valve, wherein, during the first drilling operation, the first valve and the second valve are open and the third valve and the fourth valve are closed, and wherein, during the second drilling operation, the first valve and the second valve are closed and the third valve and the fourth valve are open.

* * * * *